US010907118B2

(12) United States Patent
Piorkowski et al.

(10) Patent No.: US 10,907,118 B2
(45) Date of Patent: Feb. 2, 2021

(54) USE OF ETHYLENEOXY AND PROPYLENEOXY COPOLYMER TO CONTROL RHEOLOGY OF UNIT DOSE DETERGENT PACK

(71) Applicant: Henkel IP & Holding GmbH, Duesseldorf (DE)

(72) Inventors: Daniel T Piorkowski, Fairfield, CT (US); Casey Camire, Shelton, CT (US)

(73) Assignee: Henkel IP & Holding GmbH

( * ) Notice: Subject to any disclaimer, the term of this patent is extended or adjusted under 35 U.S.C. 154(b) by 0 days.

(21) Appl. No.: 16/231,309

(22) Filed: Dec. 21, 2018

(65) Prior Publication Data

US 2020/0199503 A1 Jun. 25, 2020

(51) Int. Cl.

| | |
|---|---|
| ***C11D 1/22*** | (2006.01) |
| ***C11D 1/29*** | (2006.01) |
| ***C11D 1/72*** | (2006.01) |
| ***C11D 1/83*** | (2006.01) |
| ***C11D 3/37*** | (2006.01) |
| ***C11D 17/04*** | (2006.01) |
| *C11D 1/722* | (2006.01) |

(52) U.S. Cl.

CPC ..... *C11D 17/043* (2013.01); *C11D 1/83* (2013.01); *C11D 3/3707* (2013.01); *C11D 1/29* (2013.01); *C11D 1/722* (2013.01)

(58) Field of Classification Search

CPC .... C11D 1/22; C11D 1/29; C11D 1/72; C11D 1/721; C11D 1/722; C11D 1/83; C11D 3/3707; C11D 17/042

See application file for complete search history.

(56) References Cited

U.S. PATENT DOCUMENTS

| | | | | |
|---|---|---|---|---|
| 6,482,792 | B2 | 11/2002 | Ip | |
| 6,566,317 | B2 | 5/2003 | Morris et al. | |
| 2018/0100124 | A1* | 4/2018 | Piorkowski | C11D 3/3707 |
| 2018/0216037 | A1 | 8/2018 | Hamersky | |
| 2018/0216052 | A1* | 8/2018 | Denome | C11D 3/3723 |
| 2018/0312788 | A1 | 11/2018 | Naqvi | |

FOREIGN PATENT DOCUMENTS

| | | | |
|---|---|---|---|
| JP | 2015193859 | A | 11/2015 |
| WO | 2000071655 | A1 | 11/2000 |

OTHER PUBLICATIONS

PCT Search Report PCT/US2019/068065 Completed: Apr. 22, 2020 dated Apr. 23, 2020 3 Pages.

* cited by examiner

*Primary Examiner* — Brian P Mruk
(74) *Attorney, Agent, or Firm* — Bojuan Deng

(57) ABSTRACT

A unit dose detergent pack includes a pouch and a detergent composition encapsulated within the pouch. The detergent composition includes a surfactant component including an alcohol ethoxy sulfate having a $C_8$-$C_{20}$ backbone that is ethoxylated with from about 1 to about 10 moles of ethylene oxide and is present in an amount of from about 5 to about 30 weight percent actives, water present in a total amount of from about 5 to about 30 weight percent, and a particular liquid block copolymer present in an amount of at least about 0.5 weight percent actives. The detergent composition has a viscosity of less than about 5,000 cps when diluted with additional water at about a 2:1 weight ratio of the detergent composition:water. The block copolymer is incorporated as a rheology modifying agent.

19 Claims, 4 Drawing Sheets

USE OF ETHYLENEOXY AND PROPYLENEOXY COPOLYMER TO CONTROL RHEOLOGY OF UNIT DOSE DETERGENT PACK

FIELD OF THE INVENTION

The present disclosure generally relates to a unit dose pack that includes a detergent composition, and methods of forming both the composition and the pack. More specifically, the disclosure relates to inclusion of a ethyleneoxy (EO) and propyleneoxy (PO) copolymer which facilitates dilution of a detergent composition.

BACKGROUND OF THE INVENTION

Many current detergent compositions include surfactants, such as sodium laureth sulfate. However, detergent compositions that that include sodium laureth sulfate can be difficult to dissolve. For example, such detergent compositions, upon dilution with water, may have viscosities, at one point, approach 400 Pa·S when measured at a shear rate of 0.42 l/sec using commonly available rheometers. As a result, the surfactants may not homogeneously and promptly disperse in water when in use and their cleaning effectiveness is compromised. Accordingly, there remains an opportunity for improvement. It is preferred that detergent compositions maintains a consistent, low viscosity profile to enhance hydration and dissolution profile. Furthermore, other desirable features and characteristics of the present disclosure will become apparent from the subsequent detailed description of the disclosure and the appended claims, taken in conjunction this background of the disclosure.

BRIEF SUMMARY OF THE INVENTION

This disclosure provides a unit dose detergent pack including a pouch made of a water-soluble film and a detergent composition encapsulated within the pouch. The detergent composition includes a surfactant component including an alcohol ethoxy sulfate having a $C_8$-$C_{20}$ backbone that is ethoxylated with from about 1 to about 10 moles of ethylene oxide and is present in an amount of from about 5 to about 30 weight percent actives based on a total weight of the detergent composition. The detergent composition also includes water present in a total amount of from about 5 to about 30 weight percent based on a total weight of the detergent composition. The detergent composition further includes a liquid block copolymer present in an amount of at least about 0.5 weight percent actives based on a total weight of the detergent composition and having the following formulae:

$$R^1O\text{-}(EO)_x\text{-}(PO)_y\text{-}R^2 \quad \text{(I);}$$

$$R^1O\text{-}(PO)_x\text{-}(EO)_y\text{-}R^2 \quad \text{(II);}$$

$$R^1O\text{-}(EO)_a\text{-}(PO)_b\text{-}(EO)_c\text{-}R^2 \quad \text{(III); and/or}$$

$$R^1O\text{-}(PO)_a\text{-}(EO)_b\text{-}(PO)_c\text{-}R^2 \quad \text{(IV).}$$

In these formulae, EO is a —$CH_2CH_2O$— group and PO is a —$CH(CH_3)CH_2O$— group. Furthermore, each of $R^1$ and $R^2$ is independently H or a $C_1$-$C_{22}$ alkyl group, wherein each of x, y, a, b, and c is independently about 1 to about 70 provided that the weight average molecular weight of the liquid block copolymer is less than about 5,000 g/mol. Moreover, the detergent composition has a viscosity of less than about 5,000 cps when diluted with additional water at about a 2:1 weight ratio of the detergent composition:water. The liquid block copolymer is incorporated as a rheology modifying agent.

This disclosure also provides the detergent composition itself.

This disclosure further provides a method for modifying rheology of the detergent composition. The method includes the step of providing a detergent composition that includes the aforementioned surfactant component, water, and liquid block copolymer. The method also includes the step of diluting the detergent composition with additional water such that the detergent composition has a viscosity of less than about 5,000 cps when diluted with the water at about a 2:1 weight ratio of detergent composition:water.

The detergent composition exhibits superior and unexpected results. More specifically, the liquid block copolymer surprisingly reduces the viscosity of the detergent composition upon dilution with water which, in turn, allows for larger amounts of water to be included in unit dose packs, allows for simplified formulations to be produced, less chemicals to be used, less chemical waste to be generated, and decreased production costs to be realized. Moreover, the liquid block copolymer allows the detergent compositions to maintain cleaning effectiveness after dilution due to the decreased viscosity. This allows the packs to be used in a wider variety of environments.

The liquid block copolymer also allows for increased cleaning effectiveness. Compositions of this disclosure are also able to exit a partially dissolved unit dose pack with greater ease as well since a water-soluble film could take up upwards of five minutes to dissolve. The water-soluble film of the unit dose pack normally partially dissolves in one area, allowing the contents to leech into the external environment prior to all of the water-soluble film dissolving. Higher viscosity liquids have a more difficult time exiting a partially dissolved unit dose pack and thus take longer to leech. This increases cleaning time and may also decrease cleaning effectiveness.

Moreover, the liquid block copolymer allows the detergent composition to maintain a consistent low viscosity profile to enhance hydration and to enhance its dissolution profile as well.

Without wishing to be bound by theory, it is believed that by incorporating the rheology modifying agent, the detergent composition not only shows a trend of changing the behavior of the fluids (from non-Newtonian to Newtonian) but also lowering the viscosity of the detergent composition upon dilution with water, compared to when the rheology modifying agent is not added. Both are advantageous for dissolution of the unit dose detergent product when it is used in a washing machine. In other words, the present inventions provides a detergent composition with a Newtonian or approximate Newtonian behavior during hydration.

BRIEF DESCRIPTION OF THE DRAWINGS

The present disclosure will hereinafter be described in conjunction with the following Figures, wherein.

DETAILED DESCRIPTION OF THE INVENTION

Figure 1:
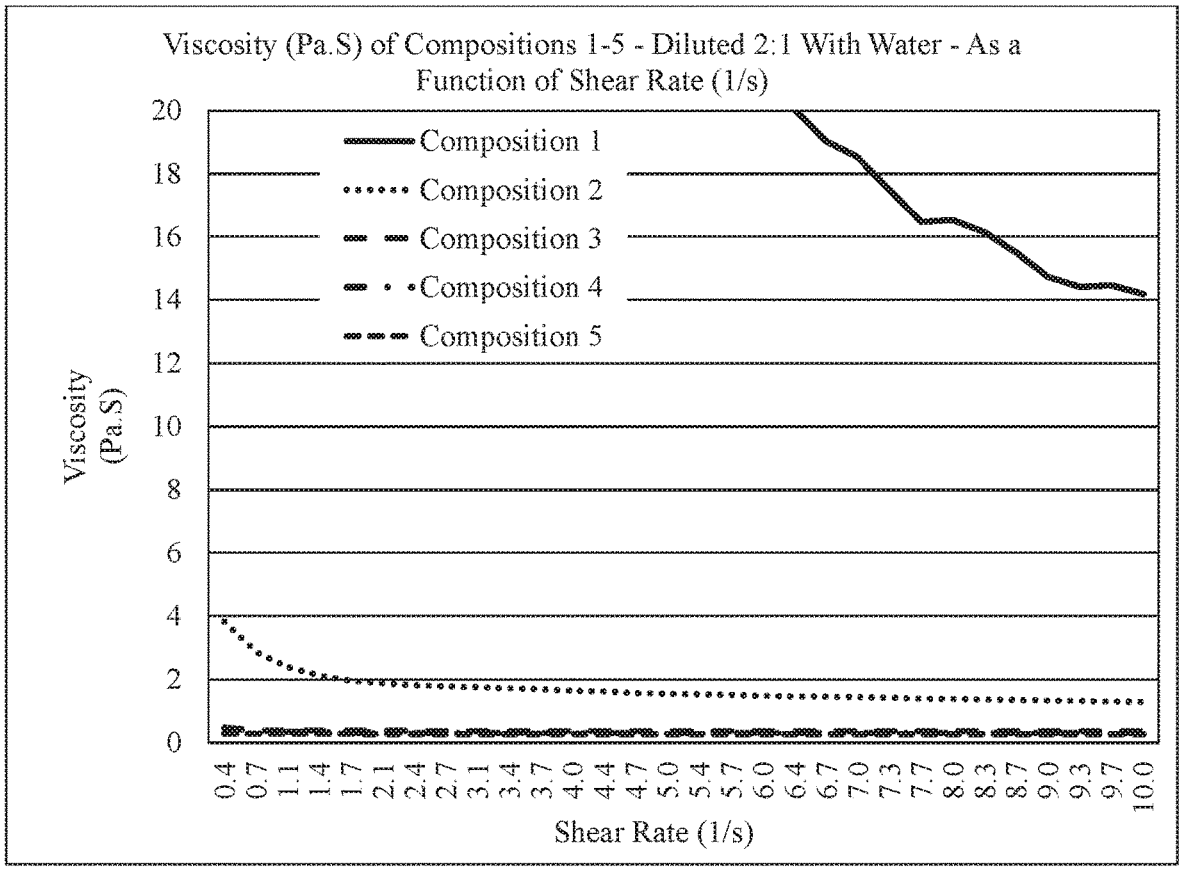
FIG. 1 is a line graph of Viscosity of Compositions 1-5—Diluted 2:1 With Water—as a Function of Shear Rate, as set forth in the Examples.

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

In one aspect, the present disclosure provides a detergent composition with a consistent, low viscosity profile during hydration and dissolution. The detergent composition may comprise a particular surfactant, water, and a particular liquid block copolymer, as described in detail below. Of the components, the liquid block copolymer is a rheology modifying agent. The detergent composition may be used in a unit dose pack detergent product.

In another aspect, the present disclosure provides a method for modifying rheology of a detergent composition. The method includes the step of providing a detergent composition that includes the aforementioned surfactant component, water, and liquid block copolymer. The method also includes the step of diluting the detergent composition with additional water such that the detergent composition has a viscosity of less than about 5,000 cps when diluted with the water at about a 2:1 weight ratio of detergent composition:water.

It was unexpectedly discovered that, as a result of incorporating the rheology modifying agent, the detergent composition shows a trend of changing the behavior of the fluids, from non-Newtonian to Newtonian. A Newtonian fluid is a fluid wherein the ratio between shear stress changes linearly in proportion to the stress to which it is exposed. This proportion is known as viscosity. A Newtonian fluid exhibits a consistent viscosity level. More specifically, Newtonian fluids also typically exhibit a commensurate, linear increase in shear stress with increases in shear rate, while non-Newtonian fluids exhibit a non-linear relationship between shear stress and shear rate. Various non-Newtonian fluids can exhibit shear thickening (i.e., an increase in viscosity with increased shear rates) or shear thinning (i.e., a decrease in viscosity with increased shear rate). Non-Newtonian fluids that exhibit shear thinning may have a yield point. The yield point is an oscillation stress at which steeper declines in viscosity are produced, as indicated by shear modulus (G') decline, with further increases in the oscillation stress beyond the yield point also producing the steeper decline in shear modulus. At oscillation stress below the yield point, changes in shear rate with stress have a minimal to no impact on the viscosity of the material. At oscillation stress above the yield point, the material begins to exhibit rapid viscosity decreases with increased levels of stress.

It was also unexpectedly discovered that incorporation of the rheology modifying agent in a detergent composition also lowers the viscosity of the detergent composition upon dilution with water, compared to when the rheology modifying agent is not added. The consistent, low viscosity profile is advantageous for dissolution of the unit dose detergent product when it is used in a washing machine.

Unit Dose Pack:

This disclosure provides a unit dose pack that includes a pouch made of a water-soluble film and a detergent composition encapsulated within the pouch, each as described below.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

Detergent Composition

This disclosure provides the detergent composition, first introduced above and hereinafter referred to as a composition. The composition may be, include, consist essentially of, or consist of, a surfactant component including an alcohol ethoxy sulfate, water, and a liquid block copolymer, as each is described below, e.g. in any one or more of the amounts described in greater detail below.

In one embodiment, the composition comprises the surfactant component including an alcohol ethoxy sulfate, water, and the liquid block copolymer.

In another embodiment, the composition consists essentially of the surfactant component including an alcohol ethoxy sulfate, water, and the liquid block copolymer.

In still another embodiment, the composition consists of the surfactant component including an alcohol ethoxy sulfate, water, and the liquid block copolymer.

In yet another embodiment, the composition comprises the surfactant component including an alcohol ethoxy sulfate, water, the liquid block copolymer and an additional anionic surfactant.

In another embodiment, the composition consists essentially of the surfactant component including an alcohol ethoxy sulfate, water, the liquid block copolymer and the additional anionic surfactant.

In another embodiment, the composition consists of the surfactant component including an alcohol ethoxy sulfate, water, the liquid block copolymer and the additional anionic surfactant.

In yet another embodiment, the composition comprises the surfactant component including an alcohol ethoxy sulfate, water, the liquid block copolymer and a non-ionic surfactant.

In another embodiment, the composition consists essentially of the surfactant component including an alcohol ethoxy sulfate, water, the liquid block copolymer and the non-ionic surfactant.

In another embodiment, the composition consists of the surfactant component including an alcohol ethoxy sulfate, water, the liquid block copolymer and the non-ionic surfactant.

In yet another embodiment, the composition comprises the surfactant component including an alcohol ethoxy sulfate, water, the liquid block copolymer, the additional anionic surfactant, and the non-ionic surfactant.

In another embodiment, the composition consists essentially of the surfactant component including an alcohol ethoxy sulfate, water, the liquid block copolymer, the additional anionic surfactant, and the non-ionic surfactant.

In another embodiment, the composition consists of the surfactant component including an alcohol ethoxy sulfate, water, the liquid block copolymer, the additional anionic surfactant, and the non-ionic surfactant.

In one embodiment, the composition comprises the surfactant component including an alcohol ethoxy sulfate and present in an amount of from about 5 to about 30 weight percent actives based on a total weight of the composition; water present in a total amount of from about 5 to about 30 weight percent based on a total weight of the composition; and a liquid block copolymer present in an amount of at least about 0.5 weight percent actives based on a total weight of the composition, each as described in greater detail below.

In another embodiment, the composition consists essentially of the surfactant component including an alcohol ethoxy sulfate and present in an amount of from about 5 to about 30 weight percent actives based on a total weight of the composition, water present in a total amount of from about 5 to about 30 weight percent based on a total weight of the composition, and a liquid block copolymer present in an amount of at least about 0.5 weight percent actives based on a total weight of the composition, each as described in greater detail below.

In still other embodiments, the composition may comprise, consist essentially of, or consist of, any combination of components described herein, in any amounts described herein.

In further embodiments, the composition is free of, or includes less than 1, 0.5, 0.1, 0.05, or 0.01, weight percent of, any one or more of the optional components or additives described below and/or those such as, but not limited to, cationic surfactants, amphoteric (zwitterionic surfactants), etc.

Surfactant Component

As first introduced above, the composition includes the surfactant component. The surfactant component includes an alcohol ethoxy sulfate, which may be described as an anionic surfactant. The alcohol ethoxy sulfate has a $C_8$-$C_{20}$ backbone that is ethoxylated with from about 1 to about 10 moles of ethylene oxide. Alternatively, the alcohol ethoxy sulfate may be described as having a $C_8$-$C_{20}$ backbone and about 1 to 10 moles of ethylene oxide units bonded thereto. The metal may be any metal but is typically sodium or potassium. The backbone of the surfactant component may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. Various mixtures of alcohol ethoxy sulfates may also be used wherein different length backbones are utilized. The backbone is ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide.

In various embodiments, the alcohol ethoxy sulfate is further defined as sodium laureth sulfate (SLES) having the formula: $CH_3(CH_2)_{10}CH_2(OCH_2CH_2)_nOSO_3Na$ wherein n is from about 1 to about 10. In another embodiment, the alcohol ethoxy sulfate is sodium laureth sulfate ethoxylated with about 2 to about 4 moles of ethylene oxide.

The surfactant component is present in an amount of from about 5 to about 30, about 10 to about 25, about 10 to about 20, or about 15 to about 20, weight percent actives based on a total weight of the composition. The entire weight of the surfactant component may be the weight of the alcohol ethoxy sulfate itself without any additional surfactants included in this weight. Alternatively, other surfactants may be included in this weight percentage. In various non-limiting embodiments, all values, both whole and fractional, between and including all of the above, are hereby expressly contemplated for use herein.

Additional Surfactants:

The composition may also include one or more additional surfactants. The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

Linear Alkylbenzene Sulfonate

In one embodiment, the additional anionic surfactant is linear alkylbenzene sulfonate (LAS). The linear alkylbenzene sulfonate may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. The additional anionic surfactant, e.g. the linear alkylbenzene sulfonate (LAS), may be present in an amount of from greater than about zero to about 20, e.g. about 1 to about 20, about 5 to about 20, about 5 to about 15, about 5 to about 10, about 10 to about 20, about 10 to about 15, about 15 to about 20, 1, 2, 3, 4, 5, 6, 7, 8, 9, 10, etc., weight percent actives based on a total weight of the composition. In various non-limiting embodiments, all values, both whole and fractional, between and including all of the above, are hereby expressly contemplated for use herein.

In some embodiments, the detergent composition is free of LAS.

Alkoxylated Alcohol

In another embodiment, the additional surfactant is a non-ionic surfactant. This non-ionic surfactant may be a $C_8$-$C_{20}$ alcohol that is capped with (or comprises) approximately 2 to 12 moles of an alkylene oxide. In other embodiments, this non-ionic surfactant is an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alcohol alkoxylate may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein. The additional surfactant, e.g. the aforementioned alkoxylated alcohol, may be present in an amount of from greater than about zero to about 30, e.g. about 1 to about 30, about 3 to about 30, about 5 to about 30, about 10 to about 25, about 15 to about 20, about 20 to about 25, about 25 to about 30, about 20 to about 30, about 15 to about 25, about 20, 21, 22, 23, 24, 25, etc., weight percent actives based on a total weight of the composition. In various non-limiting embodiments, all values, both whole and fractional, between and including all of the above, are hereby expressly contemplated for use herein.

Anionic and Non-Ionic Surfactants:

In other embodiments, the one or more additional surfactants may be or include anionic surfactants which include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding mono-olefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

In one embodiment, the additional anionic surfactant is linear alkylbenzene sulfonate and the non-ionic surfactant is an ethoxylated alcohol. In another embodiment, the ethoxylated alcohol comprises a $C_8$-$C_{20}$ backbone that is ethoxylated with from about 2 to about 12 moles of ethylene oxide. In another embodiment, the ethoxylated alcohol comprises a $C_{12}$-$C_{14}$ backbone that is ethoxylated with from about 6 to about 8 moles of ethylene oxide. In a further embodiment, the alcohol ethoxy sulfate is sodium laureth sulfate and the sodium laureth sulfate, the linear alkylbenzene sulfonate, and the ethoxylated alcohol are present in a weight ratio of about 0.2:1:0.2 to about 5:1:5. In one embodiment, the sodium laureth sulfate, the linear alkylbenzene sulfonate, and the ethoxylated alcohol are present in a weight ratio of about 3:1:5. In various non-limiting embodiments, all values, both whole and fractional, between and including all of the above, are hereby expressly contemplated for use herein.

Water:

Water is present in the composition in an amount of from about 5 to about 30 weight percent based on a total weight of the composition. In various embodiments, water is present in a total amount of from about 5 to about 25, about 5 to about 20, about 10 to about 15, about 10 to about 18, about 15 to about 20, about 20 to about 25, or about 15 to about 25, weight percent based on a total weight of the composition. Typically, the terminology "total amount" refers to a total amount of water present in the composition from all components, i.e., not simply water added independently from, for example, the surfactant component and/or the liquid block copolymer. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Liquid Block Copolymer:

The composition also includes a liquid block copolymer. This block copolymer is liquid to minimize any stability and crystallization issues that may arise if a solid compound was used. For example, the liquid block copolymer may contribute to the excellent flowability and usability of the composition in various cleaning environments. The liquid block copolymer is utilized as a rheology modifying agent.

The liquid block copolymer is present in an amount of at least about 0.5 weight percent actives based on a total weight of the composition. In various embodiments, the liquid block copolymer is present in an amount of from about 0.5 to about 20, about 1 to about 15, about 1 to about 10, about 1 to about 7.5, about 1 to about 5, about 1 to about 2.5, about 2.5 to about 10, about 2.5 to about 7.5, about 2.5 to about 5, about 7.5 to about 10, about 5 to about 10, about 5 to about 7.5, about 10 to about 15, about 7.5 to about 15, about 5 to about 15, or about 2.5 to about 15, weight percent actives based on a total weight of the composition. In other embodiments, the liquid block copolymer is present in an amount of about 1, about 2.5, about 5, about 7.5, about 10, about 12.5, about 15, about 17.5, or about 20, weight percent actives based on a total weight of the composition. In various non-limiting embodiments, all values, both whole and fractional, between and including all of the above, are hereby expressly contemplated for use herein.

The liquid block copolymer may be a single copolymer or may be a combination of copolymers. The single copolymer or the combination may have one or more of the following formulae:

$$R^1O\text{-}(EO)_x\text{-}(PO)_y\text{-}R^2 \quad \text{(I);}$$

$$R^1O\text{-}(PO)_x\text{-}(EO)_y\text{-}R^2 \quad \text{(II);}$$

$$R^1O\text{-}(EO)_a\text{-}(PO)_b\text{-}(EO)_c\text{-}R^2 \quad \text{(III); and/or}$$

$$R^1O\text{-}(PO)_a\text{-}(EO)_b\text{-}(PO)_c\text{-}R^2 \quad \text{(IV).}$$

In other words, the liquid block copolymer may be or include one or more individual copolymers each independently having formula (I), (II), (III), and/or (IV). Alternatively, the liquid block copolymer may be or include copolymers of just one of the aforementioned formulae.

The liquid block copolymers of formulae (I) and (II) may be alternatively described as block copolymers. The liquid block copolymer of formula (III) may be alternatively described as a poloxamer. The liquid block copolymer of formula (IV) may be alternatively described as a reverse poloxamer. As is appreciated in the art, poloxamers are typically nonionic triblock copolymers composed of a central hydrophobic chain of polypropylene oxide flanked by two hydrophilic chains of polyethylene oxide, e.g. as set forth in formula (III). The terminology "reverse" poloxamer describes a compound wherein the central hydrophobic chain of polypropylene oxide is substituted for a hydrophilic chain of polyethylene oxide and the flanking hydrophilic chains of polyethylene oxide are substituted for a flanking hydrophobic chains of polypropylene oxide, e.g. as set forth in formula (IV).

In the aforementioned formulae (I-IV), EO is a —$CH_2CH_2O$— group (ethyleneoxy group) and PO is a —$CH(CH_3)CH_2O$— group (propyleneoxy group). Moreover, each of $R^1$ and $R^2$ is independently H or a $C_1$-$C_{22}$ alkyl group. In one embodiment, both of $R^1$ and $R^2$ are H atoms. In another embodiment, one of $R^1$ and $R^2$ is an H atom and the other is the $C_1$-$C_{22}$ alkyl group. In a further embodiment, both of $R^1$ and $R^2$ are each independently the $C_1$-$C_{22}$ alkyl group.

Each $C_1$-$C_{22}$ alkyl group may independently be any alkyl group including linear, branched, and/or cyclic alkyl groups. Each $C_1$-$C_{22}$ alkyl group may independently have from 1 to 22, 2 to 20, 4 to 18, 6 to 16, 8 to 14, or 10 to 12, carbon atoms. Alternatively, each $C_1$-$C_{22}$ alkyl group may independently have 1, 2, 3, 4, 5, 6, 7, 8, 9, 10, 11, 12, 13, 14, 15, 16, 17, 18, 19, 20, 21, or 22, carbon atoms. In various non-limiting embodiments, all values, both whole and fractional, between and including all of the above, are hereby expressly contemplated for use herein.

Relative to formulae (I) and (II), each of x and y is independently about 1 to about 70 provided that the weight average molecular weight of the liquid block copolymer is less than about 5,000 g/mol. For example, each of x and y may be about 5 to about 65, about 10 to about 60, about 15 to about 55, about 20 to about 50, about 25 to about 45, about 30 to about 40, or about 35 to about 40. In various non-limiting embodiments, all values, both whole and fractional, between and including all of the above, are hereby expressly contemplated for use herein.

In other embodiments relative to formula (I) and (II), each of x and y may be 1, 2, 3, 4, 5, 6, 7, 8, 9, 10, 11, 12, 13, 14, 15, 16, 17, 18, 19, 20, etc. up to 70. Moreover, relative to formula (I) and (II), the ratio of x:y may be about 1:10 to about 10:1, e.g. about 1:5 to about 5:1, or about 1:2 to about 2:1. In various non-limiting embodiments, all values, both whole and fractional, between and including all of the above, are hereby expressly contemplated for use herein.

Relative to formulae (III) and (IV), each of a, b, and c is independently about 1 to about 70 provided that the weight average molecular weight of the liquid block copolymer is less than about 5,000 g/mol. For example, each of a, b, and c may be about 5 to about 65, about 10 to about 60, about 15 to about 55, about 20 to about 50, about 25 to about 45, about 30 to about 40, or about 35 to about 40. In various non-limiting embodiments, all values, both whole and fractional, between and including all of the above, are hereby expressly contemplated for use herein.

In other embodiments relative to formulae (III) and (IV), each of a, b, and c may be 1, 2, 3, 4, 5, 6, 7, 8, 9, 10, 11, 12, 13, 14, 15, 16, 17, 18, 19, 20, etc. up to 70. In still other embodiments relative to formula (III) and (IV), each of a+b+c is from about 3 to about 70, about 5 to about 65, about 10 to about 60, about 15 to about 55, about 20 to about 50, about 25 to about 45, about 30 to about 40, about 35 to about 40, about 10 to about 20, about 10 to about 15, about 15 to about 20, or about 10, 11, 12, 13, 14, 15, 16, 17, 18, 19, or 20. In various non-limiting embodiments, all values, both whole and fractional, between and including all of the above, are hereby expressly contemplated for use herein.

In still other embodiments relative to formulae (III) and (IV), the ratio of a:b:c is about 2.5:5:2.5, or about 5:2.5:5. In still other embodiments, the ratio of a:b:c is about 1:50:1 to about 50:1:1, e.g. about 1:10:1 to about 10:1:10. Further, the ratio of a:b:c may be about 1:2:1 to about 1:9:1. In various non-limiting embodiments, all values, both whole and fractional, between and including all of the above, are hereby expressly contemplated for use herein.

In still other embodiments relative to formulae (III) and (IV), the weight of a:b:c may be about 5%:90%:5% to 90%:5%:90%. In various non-limiting embodiments, all values, both whole and fractional, between and including all of the above, are hereby expressly contemplated for use herein.

For all of the formulae (I)-(IV), the aforementioned values of each of x, y, a, b, and c are chosen such that the weight average molecular weight of said liquid block copolymer is less than about 5,000 g/mol. In various embodiments, the terminology "about" refers to a ± of 10, 50, 100, or 500 g/mol. In other embodiments, the terminology "about" refers to a ± of 0.1, 0.5, 1, 2, 3, 4, 5, 6, 7, 8, 9, or 10, %.

In various embodiments, the weight average molecular weight of the liquid block copolymer is from about 100 to about 1000, about 200 to about 900, about 300 to about 800, about 400 to about 700, about 500 to about 600, about 200 to about 700, about 300 to about 800, about 100 to about 5,000, about 200 to about 2,900, about 300 to about 2,800, about 400 to about 2,700, about 500 to about 2,600, about 600 to about 2,500, about 700 to about 2,400, about 800 to about 2,300, about 900 to about 2,200, about 1,000 to about 2,100, about 1,100 to about 2,000, about 1,200 to about 1,900, about 1,300 to about 1,800, about 1,400 to about 1,700, about 1,500 to about 1,600, about 500 to about 1,000, about 500 to about 1,500, about 500 to about 2,000, about 500 to about 2,500, about 1,000 to about 1,500, about 750 to about 1,250, about 1,500 to about 3,000, about 2,000 to about 3,000, about 3,000 to about 5,000, about 3,500 to about 4,500, about 4,000 to about 4,500, about 1,000 to about 5,000, about 1,500 to about 5,000, about 2,000 to about 5,000, about 2,500 to about 5,000, etc., g/mol. In various non-limiting embodiments, all values, both whole and fractional, between and including all of the above, are hereby expressly contemplated for use herein.

In one embodiment, the liquid block copolymer has formula (IV) and a ratio of a:b:c is about 2:4.5:2 to about 3:5.5:3. In another embodiment, the liquid block copolymer has formula (IV), a ratio of a:b:c is about 2.5:5:2.5, a+b+c is about 20 to about 30, each of R' and $R^2$ is H, and the weight average molecular weight is about 1,000 g/mol. In various non-limiting embodiments, all values, both whole and fractional, between and including all of the above, are hereby expressly contemplated for use herein.

In a further embodiment, the alcohol ethoxy sulfate is sodium laureth sulfate ethoxylated with about 2 to about 4 moles of ethylene oxide, the liquid block copolymer has formula (IV), is present in an amount of from about 2 to about 6 weight percent actives based on a total weight of the composition, has a ratio of a:b:c of about 2.5:5:2.5, a+b+c is about 20 to about 30, and wherein each of R' and $R^2$ is H, and the weight average molecular weight is about 1,000 g/mol. In various non-limiting embodiments, all values, both whole and fractional, between and including all of the above, are hereby expressly contemplated for use herein.

Non-Aqueous Solvent

In some embodiments, the composition may include a non-aqueous solvent. In various embodiments, the non-aqueous solvent is present in an amount of from about 1 to about 30, about 3 to about 30, about 5 to about 30, about 10 to about 25, or about 15 to about 20, weight percent based on a total weight of the composition. In various non-limiting embodiments, all values, both whole and fractional, between and including all of the above, are hereby expressly contemplated for use herein.

The non-aqueous solvent is not particularly limited and may be any known in the art. In various embodiments, the non-aqueous solvent is chosen from glycerol (glycerin), propylene glycol, ethylene glycol, ethanol, and 4C+ compounds. The term "4C+ compound" refers to one or more of: polypropylene glycol; polyethylene glycol esters such as polyethylene glycol stearate, propylene glycol laurate, and/or propylene glycol palmitate; methyl ester ethoxylate; diethylene glycol; dipropylene glycol; tetramethylene glycol; butylene glycol; pentanediol; hexylene glycol; heptylene glycol; octylene glycol; 2-methyl, 1,3 propanediol; triethylene glycol; polypropylene glycol; glycol ethers, such as ethylene glycol monobutyl ether, diethylene glycol monobutyl ether, triethylene glycol monobutyl ether, ethylene glycol monopropyl ether, diethylene glycol monoethyl ether, triethylene glycol monoethyl ether, diethylene glycol monomethyl ether, and triethylene glycol monomethyl ether; tris (2-hydroxyethyl)methyl ammonium methylsulfate; ethylene oxide/propylene oxide copolymers with a number average molecular weight of 3,500 Daltons or less; and ethoxylated fatty acids. In other embodiments, the non-aqueous solvent is a relatively low molecular weight polyethylene glycol (PEG) having a weight average molecular weight of less than about 600 Da, e.g. about 400, such as those having a weight average molecular weight of from about 380 to about 420, Da. In other embodiments, PEG 200, PEG 250, PEG 300, PEG 350, PEG 400, PEG 450, PEG 500, PEG 550, and/or PEG 600 (wherein the numerals represent the approximate weight average molecular weight in Daltons) may be used. Other suitable non-aqueous solvents include ethylene oxide/propylene oxide block copolymers. In various non-limiting embodiments, all values, both whole and fractional, between and including all of the above, are hereby expressly contemplated for use herein.

In other embodiments, the composition is free of the non-aqueous solvent.

Additives:

The composition may include one or more of the following additives or may be free of one or more of the following additives. For example, the composition may include one or more foam inhibitors (e.g. defoaming agents). Suitable foam inhibitors include, but are not limited to, fatty acids such as coconut fatty acids. The composition may include the foam inhibitor at an amount of from about 0 to about 10 weight percent, based on the total weight of the composition. In various non-limiting embodiments, all values, both whole and fractional, between and including all of the above, are hereby expressly contemplated for use herein.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include neutralizers/pH adjustors just as monoethanolamine and the like, enzymes, optical brighteners, chelators, and combinations thereof. These additives may be chosen from any known in the art.

In one embodiment, the composition is free of, or includes less than 5, 4, 3, 2, 1, 0.5, or 0.1, weight percent of, a solvent other than water, e.g. any organic solvent, non-polar solvent, polar aprotic solvent, polar protic solvent, etc. and combinations thereof. In another embodiment, the composition is free of, or includes less than 5, 4, 3, 2, 1, 0.5, or 0.1, weight percent of, propylene glycol and/or glycerine. In various non-limiting embodiments, all values, both whole and fractional, between and including all of the above, are hereby expressly contemplated for use herein.

Weight Percents/Ratios of Various Components:

The surfactant component, water, and liquid block copolymer are generally present in amounts within the weight ranges set forth above. However, in additional embodiments, these weight ranges may be narrower and/or specific weight ratios may be utilized. These weight ranges and/or ratios may be representative of embodiments that produce special, superior, and unexpected results, such as those demonstrated in the Examples. Relative to all of the paragraphs set forth immediately below, in various non-limiting embodiments, all values, both whole and fractional, between and including all of the above, are hereby expressly contemplated for use herein.

In various embodiments, the liquid block copolymer is present in an amount of about 1, about 2.5, about 5, or about 7.5, weight percent actives based on a total weight of the composition, and water is present in a weight ratio with the composition of about 1:2.

In other embodiments, the liquid block copolymer is present in an amount of about 1, about 2.5, about 5, or about 7.5, weight percent actives based on a total weight of the composition, and water is present in a weight ratio with the composition of about 1:1.

In still other embodiments, the surfactant component is present in an amount of about 15 to about 16 weight percent actives based on a total weight of the composition, the liquid block copolymer is present in an amount of about 1, about 2.5, about 5, or about 7.5, weight percent actives based on a total weight of the composition, and water is present in a weight ratio with the composition of about 1:2.

In other embodiments, the surfactant component is present in an amount of about 15 to about 16 weight percent actives based on a total weight of the composition, the liquid block copolymer is present in an amount of about 1, about 2.5, about 5, or about 7.5, weight percent actives based on a total weight of the composition, and water is present in a weight ratio with the composition of about 1:1.

In further embodiments, the surfactant component is present in an amount of about 15 to about 16 weight percent actives based on a total weight of the composition, the liquid block copolymer is present in an amount of about 1, about 2.5, about 5, or about 7.5, weight percent actives based on a total weight of the composition, water is present in a weight ratio with the composition of about 1:2, and the additional anionic surfactant is present in an amount of from greater than about zero to about 20, e.g. about 5, weight percent actives based on a total weight of the composition.

In other embodiments, the surfactant component is present in an amount of about 15 to about 16 weight percent actives based on a total weight of the composition, the liquid block copolymer is present in an amount of about 1, about 2.5, about 5, or about 7.5, weight percent actives based on a total weight of the composition, and water is present in a weight ratio with the composition of about 1:1, and the additional anionic surfactant is present in an amount of from greater than about zero to about 20, e.g. about 5, weight percent actives based on a total weight of the composition.

In further embodiments, the surfactant component is present in an amount of about 15 to about 16 weight percent actives based on a total weight of the composition, the liquid block copolymer is present in an amount of about 1, about 2.5, about 5, or about 7.5, weight percent actives based on a total weight of the composition, water is present in a weight ratio with the composition of about 1:2, the additional anionic surfactant is present in an amount of from greater than about zero to about 20, e.g. about 5, weight percent actives based on a total weight of the composition, and a non-ionic surfactant is present in an amount of from about 3 to about 30, e.g. about 23, weight percent actives based on a total weight of the composition.

In other embodiments, the surfactant component is present in an amount of about 15 to about 16 weight percent actives based on a total weight of the composition, the liquid block copolymer is present in an amount of about 1, about 2.5, about 5, or about 7.5, weight percent actives based on a total weight of the composition, and water is present in a weight ratio with the composition of about 1:1, the additional anionic surfactant is present in an amount of from greater than about zero to about 20, e.g. about 5, weight percent actives based on a total weight of the composition, and a non-ionic surfactant is present in an amount of from about 3 to about 30, e.g. about 23, weight percent actives based on a total weight of the composition.

In even further embodiments, the actives of the surfactant component, water, and the actives of the liquid block copolymer are present in weight ratios of about 15:15:1; about 15:15:2.5; about 15:15:5, or about 15:15:7.5, or any range therebetween. In various non-limiting embodiments, all values, both whole and fractional, between and including all of the above, are hereby expressly contemplated for use herein.

In even further embodiments, the actives of the surfactant component, water, the actives of the liquid block copolymer, and the actives of the additional anionic surfactant are present in weight ratios of about 15:15:1:5; about 15:15:2.5:5; about 15:15:5:5, or about 15:15:7.5:5, or any range therebetween. In various non-limiting embodiments, all values, both whole and fractional, between and including all of the above, are hereby expressly contemplated for use herein.

In even further embodiments, the actives of the surfactant component, water, the actives of the liquid block copolymer, and the actives of the non-ionic surfactant are present in weight ratios of about 15:15:1:23; about 15:15:2.5:23; about 15:15:5:23, or about 15:15:7.5:23, or any range therebetween. In various non-limiting embodiments, all values, both whole and fractional, between and including all of the above, are hereby expressly contemplated for use herein.

In even further embodiments, the actives of the surfactant component, water, the actives of the liquid block copolymer, the actives of the additional anionic surfactant, and the actives of the non-ionic surfactant are present in weight ratios of about 15:15:1:5:23; about 15:15:2.5:5:23; about 15:15:5:5:23, or about 15:15:7.5:5:23, or any range therebetween. In another embodiment, the alcohol ethoxy sulfate, the additional anionic surfactant, and the non-ionic surfactant are present in a weight ratio of about 0.2:1:0.2 to about 5:1:5. In various non-limiting embodiments, all values, both whole and fractional, between and including all of the above, are hereby expressly contemplated for use herein.

Physical Properties:

Typically, compositions that include alcohol ethoxy sulfates have viscosity issues upon dilution with water. However, the composition of the instant disclosure resists unwanted increases in viscosity upon dilution with water. For example, the composition of this disclosure has a viscosity of less than about 5,000 cps when diluted with additional water at about a 2:1 weight ratio of composition: water. In various embodiments, the viscosity is less than about 4,500, about 4,000, about 3,500, about 3,000, about 2,500, about 2,000, about 1,500, about 1,000, or about 500, cps when diluted with additional water at about a 2:1 weight ratio of composition:water. In other embodiments, and as was introduced above, the viscosity is from about 100 to about 5,000, about 100 to about 4,500, about 100 to about 4,000, about 100 to about 3,500, about 100 to about 2,500, about 100 to about 2,000, from about 100 to about 1,500, from about 100 to about 1,000, from about 100 to about 500, from about 500 to about 1,000, about 200 to about 500, about 250 to about 450, about 300 to about 400, about 300 to about 350, about 350 to about 500, etc. In other embodiment, the dilution with water is at about 1:1 to about 1:0.33 of the composition:water. Typically, maximum increase in viscosity would be observed at about 2:1 composition:water such that particularly special unexpected results associated with minimized viscosity increase are observed at this approximate weight ratio. In various non-limiting embodiments, all values, both whole and fractional, between and including all of the above, are hereby expressly contemplated for use herein.

The viscosity of the composition, e.g. those described above, may be measured using various techniques. For example, the viscosity may be measured using a Brookfield viscometer and any one or more spindles, as is chosen by one of skill in the art. In various embodiments, the composition has one or more of the aforementioned viscosities measured using a DV2T Brookfield viscometer at 20 rpm and 70° F. using spindle LV02(62). Alternatively, the viscosity may be described as being measured using a rheometer, e.g. any known in the art. In various embodiments, the composition has one or more of the aforementioned viscosities measured using an AR2000-EX Rheometer at a shear rate of 1.08 l/s over 5 minutes at 20° C. with a geometry cone of 40 mm, 1:59:49 degree:min:sec, and a truncation gap of 52 microns. However, the shear rate, time, temperature, geometry cone, values for degree:min:sec, and truncation gap may all vary and be chosen by one of skill in the art. For example, the shear rate may be measured as is set forth in the Examples and Figures. In various non-limiting embodiments, all values, both whole and fractional, between and including all of the above, are hereby expressly contemplated for use herein.

Additional Embodiments

In an additional embodiment, the detergent composition consists essentially of sodium laureth sulfate ethoxylated with about 2 to about 4 moles of ethylene oxide and present in an amount of from about 15 weight percent actives based on a total weight of the detergent composition; water present in a total amount of from about 10 to about 18 weight percent based on a total weight of the detergent composition; a liquid block copolymer present in an amount of about 2 to about 6 weight percent actives based on a total weight of the detergent composition and having the following formulae: $R^1O\text{-}(EO)_a\text{—}(PO)_b\text{-}(EO)_c\text{—}R^2$ (III); and/or $R^1O\text{-}(PO)_a\text{-}(EO)_b\text{-}(PO)_c\text{-}R^2$ (IV), wherein EO is —$CH_2CH_2O$— group and PO is a —$CH(CH_3)CH_2O$— group; wherein each of $R^1$ and $R^2$ is independently H or a $C_1$-$C_{22}$ alkyl group; wherein each of a, b, and c is independently about 1 to about 70 provided that the weight average molecular weight of the liquid block copolymer is less than about 1,500 g/mol, an ethoxylated alcohol comprising a $C_{12}$-$C_{14}$ backbone that is ethoxylated with from about 6 to about 8 moles of ethylene oxide; a defoaming agent, and a solvent, wherein the detergent composition has a viscosity of less than about 2,500 cps when diluted with additional water at about a 2:1 weight ratio of detergent composition:water. In a related embodiment, the detergent composition further consists essentially of linear alkylbenzene sulfonate. In various non-limiting embodiments, all values, both whole and fractional, between and including all of the above, are hereby expressly contemplated for use herein.

This disclosure also provides a detergent composition exhibiting approximate Newtonian behavior during hydration. The terminology "approximate Newtonian behavior" is as is understood by those of skill in the art, wherein Newtonian behavior is as described above. Moreover, the terminology "during hydration" typically describes a time when the detergent composition is diluted with water. As is described above, this dilution is typically effected using an independent source of water, such as DI water. The detergent composition includes the surfactant composition, water, and the liquid block copolymer described above.

Method of Forming Unit Dose Pack:

This disclosure also provides a method of forming the unit dose pack. The composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

Method of Forming the Detergent Composition:

This disclosure further provides a method of forming the detergent composition. The method includes the step of combining the surfactant component, water, and the liquid block copolymer, and optionally any additional solvents, surfactants, additives, etc., to form the detergent composition. Each of the aforementioned components may be combined in any order and in whole or partial amounts. Moreover, any of the aforementioned additives may be combined as well with one or more of the aforementioned fragrance, saccharide, surfactant, or water. All orders of addition are hereby expressly contemplated for use in various non-limiting embodiments.

Method for Modifying Rheology of the Detergent Composition:

As first introduced above, this disclosure further provides a method for modifying rheology of the detergent composition. The method includes the step of providing a detergent composition that includes the aforementioned surfactant component, water, and liquid block copolymer. The step of providing may be any known in the art. The detergent composition may be provided after it is formed using the method described above.

The method also includes the step of diluting the detergent composition with additional water such that the detergent composition has a viscosity of less than about 5,000 cps when diluted with the water at about a 2:1 weight ratio of detergent composition:water. The step of diluting may be further defined as adding additional water to the detergent composition, such as from the independent source of DI water described above, to a desired dilution weight ratio. The step of diluting may be accomplished as a batch or continuous operation.

EXAMPLES

A masterbatch composition, as set forth below in Table 1 below, is used to form a series of compositions both representative of embodiments of this disclosure (Inventive) and comparative (Comp.). All values set forth in Table 1 are in parts by weight per 100 parts by weight of the Compositions. More specifically, the total weight of the masterbatch composition is 92.5 parts. The additional 7.5 parts is supplied either as glycerine alone (comparative), as 1, 2.5, or 5 wt % of the liquid block copolymer with a balance of glycerine to total 7.5 parts (inventive), or as 7.5 parts of the liquid block copolymer itself without any glycerine (inventive). All Compositions have a viscosity of approximately 200 to 250 cP as-is (i.e., without dilution). The liquid block copolymer has a weight average molecular weight of about 1000 g/mol, has the general formula (IV) set forth above wherein a ratio of PO:EO:PO is 1:2:1 (i.e., wherein the ratio of a:b:c is 1:2:1).

TABLE 1

| Masterbatch Composition | Parts |
|---|---|
| Glycerine | 7.370 |
| C12-C15 Alcohol Ethoxylate - 7 E/O | 23.074 |
| Propylene Glycol | 8.206 |
| Monoethanolamine | 3.150 |
| Water | 5.700 |
| Linear Alkylbenzene Sulfonate | 5.000 |
| Coconut Oil Fatty Acid | 10.000 |
| Sodium Laureth Sulfate (~60 wt % actives) | 26.000 |
| Bitrex | 0.050 |
| Enzymes (~10 wt % actives) | 1.850 |
| Tinopal CBS-X Swiss | 0.200 |
| Chelator (~33 wt % actives) | 0.900 |
| Fragrance | 1.000 |
| Total | 92.500 |

In Table 1 above, the components are as follows:

C12-C15 Alcohol Ethoxylate-7 E/O is a $C_{12}$-$C_{15}$ Alcohol Ethoxylate that is capped with approximately 7 moles of ethylene oxide.

Linear Alkylbenzene Sulfonate is 2-Phenyl Sulfonic Acid.

Bitrex is a bittering additive, which is a 25% active solution in water.

Enzymes are a combination of commercially available proteases.

Tinopal CBS-X Swiss is an optical brightener.

The aforementioned Masterbatch Composition is used to form the following Compositions 1-5 wherein amounts of liquid block copolymer and/or amounts of glycerine are added to the Masterbatch Composition such that a total of the Compositions 1-5 is about 100 parts:

Composition 1 (comparative): 0 parts liquid block copolymer; 7.5 parts glycerine Composition 2 (inventive): 1 part liquid block copolymer; 6.5 parts glycerine Composition 3 (inventive): 2.5 parts liquid block copolymer; 5 parts glycerine Composition 4 (inventive): 5 parts liquid block copolymer; 2.5 parts glycerine Composition 5 (inventive): 7.5 parts liquid block copolymer; 0 parts glycerine The Compositions 1-5 are evaluated to determine viscosity using an AR2000-EX Rheometer using an increasing shear rate of from about 0.41 to about 10 l/s over 5 minutes at 20° C. with a geometry cone of 40 mm, 1:59:49 degree: min:sec, and a truncation gap of 52 microns.

In a first series of viscosity evaluations, the Compositions (Comp. 1-5) are diluted with additional water at a weight ratio of about 2 parts Composition:1 part Water. The results of these evaluations are set forth in Table 2 below wherein viscosity is set forth as Pa·S.

In a second series of viscosity evaluations, the Compositions (Comp. 1-5) are diluted with additional water at a weight ratio of about 1 part Composition:1 part Water. The results of these evaluations are set forth in Table 3 below wherein viscosity is set forth as Pa·S.

Figure 2:
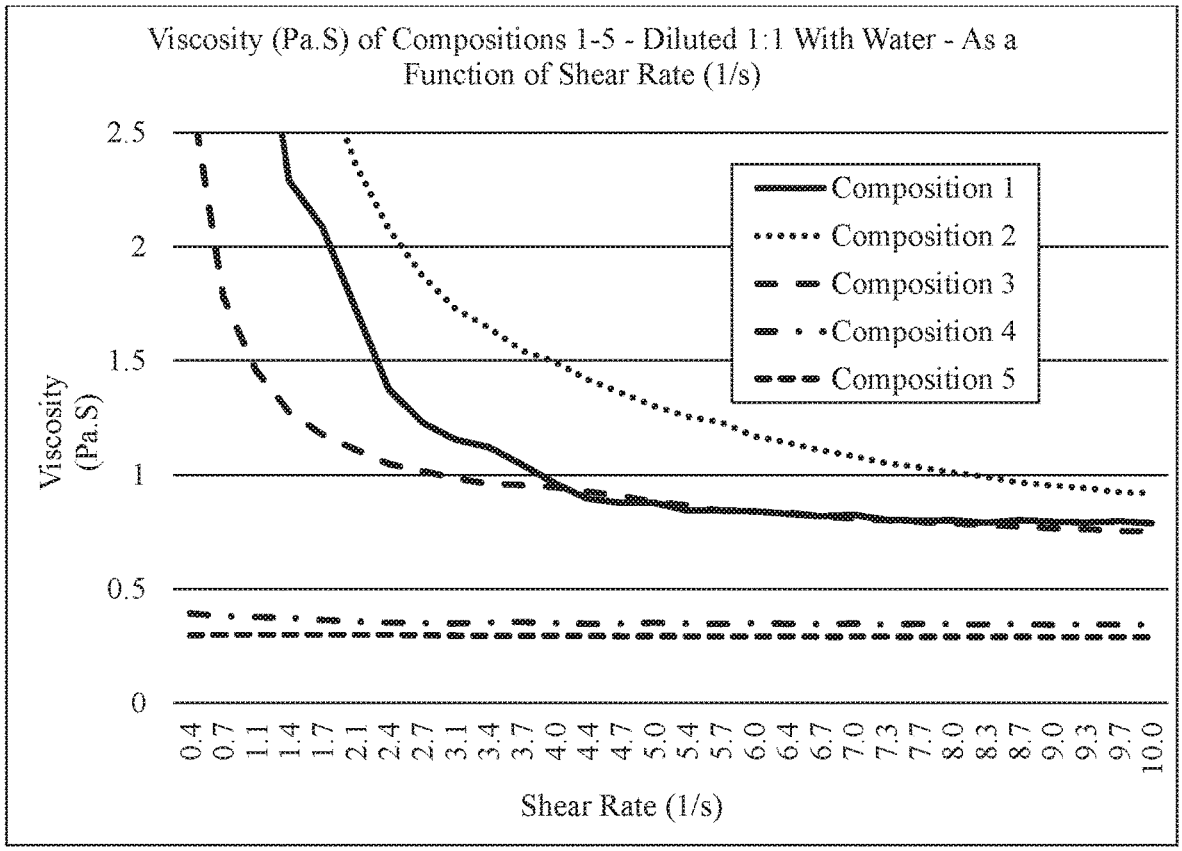
FIG. 2 is a line graph of Viscosity of Compositions 1-5—Diluted 1:1 With Water—as a Function of Shear Rate, as also set forth in the Examples.

The numerical results set forth in Tables 2 and 3 are visually depicted in the line graphs of FIGS. 1 and 2, respectively.

TABLE 2

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | Dilution at 2 Parts Composition:1 Part Water Viscosity in Pa · S | | | | |
| 0.41 | 387 | 3.815 | 0.468 | 0.4688 | 0.2828 |
| 0.75 | 192.5 | 2.859 | 0.3903 | 0.3679 | 0.2806 |
| 1.08 | 122 | 2.386 | 0.3826 | 0.3419 | 0.2803 |
| 1.41 | 90.97 | 2.121 | 0.3784 | 0.3261 | 0.2806 |
| 1.73 | 71.29 | 1.956 | 0.3752 | 0.3133 | 0.2811 |
| 2.06 | 57.5 | 1.87 | 0.3713 | 0.3099 | 0.277 |
| 2.39 | 48.02 | 1.808 | 0.3706 | 0.3057 | 0.2731 |
| 2.72 | 42.56 | 1.774 | 0.3677 | 0.3043 | 0.269 |
| 3.06 | 39.94 | 1.747 | 0.3679 | 0.3035 | 0.2672 |
| 3.39 | 36.14 | 1.712 | 0.3684 | 0.3047 | 0.2699 |
| 3.71 | 32.17 | 1.684 | 0.369 | 0.3068 | 0.2734 |
| 4.05 | 29.49 | 1.637 | 0.3678 | 0.3041 | 0.2728 |
| 4.37 | 28.06 | 1.617 | 0.366 | 0.3016 | 0.2682 |
| 4.71 | 26.03 | 1.564 | 0.3665 | 0.3019 | 0.2676 |
| 5.03 | 24.35 | 1.544 | 0.367 | 0.304 | 0.2708 |
| 5.37 | 23.01 | 1.529 | 0.3655 | 0.3019 | 0.271 |
| 5.70 | 22.26 | 1.507 | 0.3649 | 0.3005 | 0.267 |
| 6.03 | 21.26 | 1.479 | 0.3651 | 0.3023 | 0.2691 |
| 6.36 | 20.03 | 1.46 | 0.3645 | 0.3015 | 0.27 |
| 6.68 | 19.02 | 1.452 | 0.3637 | 0.2994 | 0.2666 |
| 7.02 | 18.52 | 1.438 | 0.364 | 0.3017 | 0.2694 |
| 7.35 | 17.5 | 1.42 | 0.363 | 0.2998 | 0.2678 |
| 7.68 | 16.47 | 1.391 | 0.3632 | 0.2996 | 0.267 |
| 8.01 | 16.52 | 1.38 | 0.3629 | 0.3005 | 0.2685 |
| 8.34 | 16.14 | 1.361 | 0.3622 | 0.2988 | 0.266 |
| 8.67 | 15.49 | 1.353 | 0.3626 | 0.3 | 0.2682 |
| 8.99 | 14.72 | 1.331 | 0.3618 | 0.2982 | 0.2657 |
| 9.32 | 14.41 | 1.318 | 0.3618 | 0.299 | 0.2681 |
| 9.66 | 14.46 | 1.298 | 0.3611 | 0.2977 | 0.2653 |
| 9.99 | 14.18 | 1.293 | 0.3614 | 0.2984 | 0.2675 |

TABLE 3

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | Dilution at 1 Part Composition:1 Part Water Viscosity in Pa · S | | | | |
| 0.41 | 19.54 | 16.74 | 2.707 | 0.3934 | 0.2957 |
| 0.75 | 7.06 | 7.925 | 1.781 | 0.3819 | 0.2988 |
| 1.08 | 3.193 | 4.626 | 1.452 | 0.3789 | 0.2993 |
| 1.41 | 2.29 | 3.256 | 1.274 | 0.3736 | 0.2985 |
| 1.73 | 2.085 | 2.775 | 1.176 | 0.3654 | 0.2988 |
| 2.06 | 1.728 | 2.359 | 1.11 | 0.3587 | 0.2981 |
| 2.39 | 1.373 | 2.078 | 1.047 | 0.3537 | 0.2979 |
| 2.72 | 1.23 | 1.876 | 1.017 | 0.3509 | 0.2956 |
| 3.06 | 1.154 | 1.728 | 0.9852 | 0.35 | 0.294 |
| 3.39 | 1.121 | 1.646 | 0.9613 | 0.3544 | 0.2922 |
| 3.71 | 1.045 | 1.544 | 0.9556 | 0.3561 | 0.2934 |
| 4.05 | 0.9616 | 1.493 | 0.9461 | 0.3516 | 0.2937 |
| 4.37 | 0.8958 | 1.417 | 0.9264 | 0.348 | 0.2926 |
| 4.71 | 0.8772 | 1.359 | 0.9069 | 0.35 | 0.2913 |
| 5.03 | 0.8769 | 1.3 | 0.8819 | 0.353 | 0.2915 |
| 5.37 | 0.8442 | 1.254 | 0.8661 | 0.3494 | 0.2914 |
| 5.70 | 0.8442 | 1.23 | 0.8429 | 0.347 | 0.2901 |
| 6.03 | 0.8409 | 1.169 | 0.8389 | 0.3509 | 0.2901 |
| 6.36 | 0.8293 | 1.141 | 0.8341 | 0.3485 | 0.2909 |
| 6.68 | 0.8193 | 1.107 | 0.8195 | 0.3459 | 0.2892 |

TABLE 3-continued

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | Dilution at 1 Part Composition:1 Part Water Viscosity in Pa · S | | | | |
| 7.02 | 0.8252 | 1.081 | 0.8094 | 0.3499 | 0.2895 |
| 7.35 | 0.8042 | 1.051 | 0.8027 | 0.3451 | 0.2897 |
| 7.68 | 0.7999 | 1.033 | 0.7941 | 0.3476 | 0.2885 |
| 8.01 | 0.8016 | 1.01 | 0.7879 | 0.3465 | 0.2892 |
| 8.34 | 0.7905 | 0.9923 | 0.7805 | 0.3454 | 0.2884 |
| 8.67 | 0.8017 | 0.9663 | 0.7752 | 0.3469 | 0.2888 |
| 8.99 | 0.796 | 0.9537 | 0.7658 | 0.3437 | 0.2877 |
| 9.32 | 0.792 | 0.9416 | 0.7634 | 0.346 | 0.2876 |
| 9.66 | 0.7973 | 0.9244 | 0.7543 | 0.3445 | 0.287 |
| 9.99 | 0.7892 | 0.9189 | 0.7544 | 0.3442 | 0.2876 |

As shown in Tables 2 and 3, Composition 1 (comparative) exhibits a tendency to increase in viscosity (e.g. to 10 or greater Pa·S) to varying degrees depending on dilution and shear rate. However, when varying amounts of the liquid block copolymer are added, as shown relative to Compositions 2-5 (inventive), superior and unexpected results are realized. More specifically, the use of the liquid block copolymer surprisingly reduces the viscosity of the detergent composition upon dilution with water which, in turn, allows for larger amounts of water to be included in unit dose packs, allows for simplified formulations to be produced, less chemicals to be used, less chemical waste to be generated, and decreased production costs to be realized. Moreover, use of the liquid block copolymer allows the detergent compositions to maintain cleaning effectiveness after dilution due to the decreased viscosity. This allows the packs to be used in a wider variety of environments.

For example, the liquid block copolymer was found to have a very significant and beneficial impact on controlling rheology when the Composition is diluted with additional water at the various ratios. In one instance, e.g. in Composition 5, the inclusion of the liquid block copolymer at 7.5% reduced the viscosity of the formulation (when diluted at 2 parts Composition to 1 part DI Water) from about 122,000 cP to about 280 cP at a shear rate of 1.08 l/s. This data also demonstrates the direct relationship between liquid block copolymer inclusion level and lower viscosities, with higher levels of the liquid block copolymer being more favorable. Inclusion levels of liquid block copolymer under 5% significantly impacted the rheology, unlike prior examples. Relative to Composition 5, the liquid block copolymer also controlled rheology at the 1:1 dilution, reducing viscosity from about 3190 cP to about 299 cP at a shear rate of 1.08 l/s.

More specifically, FIG. 1 shows that viscosities of Compositions 2-5 are essentially independent of shear. This means the detergent compositions are Newtonian fluids. In particular, Compositions 3-5 show a low viscosity.

Moreover, FIG. 2 shows that viscosities of Compositions 4-5 are independent of shear and are low. This means the detergent compositions are Newtonian fluids. Viscosities of Compositions 2-3 initially exhibit non-Newtonian properties at a low shear rate but change to Newtonian at a high shear rate. The viscosity of Composition 1 is non-Newtonian.

As shown in the viscosity curves of Compositions 1-5, increasing the amount of the rheology control agent in the Compositions not only shows a trend of changing the behavior of the fluids (from non-Newtonian to Newtonian) but also gradually lowering the viscosity of the Compositions, upon dilution with water. Both are advantageous for dissolution of unit dose detergent production upon exposed to water during use.

The liquid block copolymer also allows for increased cleaning effectiveness as compared to Composition 1 (comparative) since Composition 1 would go through an increase in viscosity. The Compositions 2-5 (inventive) also would be able to exit a partially dissolved unit dose pack with greater ease as well since a water-soluble (e.g. PVOH) film could take upwards of five minutes to dissolve. The water-soluble film of the unit dose pack normally partially dissolves in one area, allowing the contents to leech into the external environment prior to all of the water-soluble film dissolving. Higher viscosity liquids have a more difficult time exiting a partially dissolved unit dose pack and thus take longer to leech. This increases cleaning time and may also decrease cleaning effectiveness.

For the sake of comparison, additional viscosity evaluations of non-diluted Compositions are performed using an AR2000-EX Rheometer using an increasing shear rate of from about 0.41 to about 10 l/s over 5 minutes at 20° C. with a geometry cone of 40 mm, 1:59:49 degree:min:sec, and a truncation gap of 52 microns.

More specifically, the Compositions 1-5 above are evaluated to determine non-diluted viscosity. These results are set forth in Table 4 below.

TABLE 4

| Shear Rate (1/s) | Comp. 1 Comparative | Comp. 2 Inventive | Comp. 3 Inventive | Comp. 4 Inventive | Comp. 5 Inventive |
|---|---|---|---|---|---|
| | No Dilution in Water Viscosity in Pa · S | | | | |
| 0.41 | 0.2435 | 0.2437 | 0.2522 | 0.182 | 0.3774 |
| 0.75 | 0.2359 | 0.2098 | 0.2187 | 0.1696 | 0.2393 |
| 1.08 | 0.2326 | 0.213 | 0.2025 | 0.1622 | 0.1949 |
| 1.41 | 0.2316 | 0.2167 | 0.1921 | 0.1593 | 0.171 |
| 1.73 | 0.2303 | 0.2213 | 0.1854 | 0.1556 | 0.1612 |
| 2.06 | 0.2272 | 0.2252 | 0.1831 | 0.1513 | 0.1542 |
| 2.39 | 0.2254 | 0.2263 | 0.1853 | 0.1465 | 0.1526 |
| 2.72 | 0.2235 | 0.2221 | 0.1873 | 0.1411 | 0.1544 |
| 3.06 | 0.2235 | 0.2181 | 0.1871 | 0.1379 | 0.1566 |
| 3.39 | 0.2257 | 0.2161 | 0.1827 | 0.1396 | 0.1574 |
| 3.71 | 0.2272 | 0.2183 | 0.1787 | 0.1438 | 0.1543 |
| 4.05 | 0.2261 | 0.2229 | 0.1794 | 0.1439 | 0.1518 |
| 4.37 | 0.2234 | 0.2226 | 0.1833 | 0.1396 | 0.1528 |
| 4.71 | 0.2237 | 0.2172 | 0.1832 | 0.1383 | 0.1556 |
| 5.03 | 0.2264 | 0.2179 | 0.1794 | 0.1422 | 0.1542 |
| 5.37 | 0.225 | 0.2224 | 0.1805 | 0.1421 | 0.1514 |
| 5.70 | 0.224 | 0.2193 | 0.1838 | 0.1389 | 0.1537 |
| 6.03 | 0.2257 | 0.2177 | 0.1806 | 0.1408 | 0.1546 |
| 6.36 | 0.2255 | 0.2219 | 0.1802 | 0.1423 | 0.1518 |
| 6.68 | 0.2237 | 0.2191 | 0.1833 | 0.1386 | 0.1536 |
| 7.02 | 0.2264 | 0.2185 | 0.18 | 0.1417 | 0.1536 |
| 7.35 | 0.2246 | 0.222 | 0.1822 | 0.1407 | 0.1523 |
| 7.68 | 0.2256 | 0.2182 | 0.1817 | 0.1399 | 0.1545 |
| 8.01 | 0.2261 | 0.2216 | 0.1804 | 0.1421 | 0.152 |
| 8.34 | 0.2252 | 0.2188 | 0.1826 | 0.1394 | 0.1542 |
| 8.67 | 0.2264 | 0.221 | 0.1803 | 0.1421 | 0.1522 |
| 8.99 | 0.2251 | 0.2191 | 0.1828 | 0.1392 | 0.1539 |
| 9.32 | 0.2265 | 0.2205 | 0.1805 | 0.1422 | 0.1524 |
| 9.66 | 0.2255 | 0.219 | 0.1825 | 0.1395 | 0.1542 |
| 9.99 | 0.2265 | 0.2212 | 0.181 | 0.142 | 0.152 |

These results show that, without dilution, the Compositions have relatively similar viscosities at varying shear rates. These results also show that it is the dilution with water that causes the rapid increases in viscosity of comparative Composition 1 that does not include the liquid block copolymer. These results also further support the conclusion that it is the liquid block copolymer that is surprisingly responsible for the trend of changing the behavior of the fluids, from non-Newtonian to Newtonian.

Additional compositions, i.e., Composition 6 (comparative) and Composition 7 (inventive) are also formed as set forth in Table 5 below. All values set forth in Table 5 are in parts by weight per 100 parts by weight of the Compositions.

TABLE 5

| | Comp. 6 Comparative | Comp. 7 Inventive |
|---|---|---|
| Glycerine | 26.748 | 12.038 |
| C12-C15 Alcohol Ethoxylate - 7 E/O | 23.074 | 23.074 |
| Liquid Block Copolymer | — | 18.323 |
| Monoethanolamine | 1.750 | 1.750 |
| Water | 6.000 | 6.000 |
| Linear Alkylbenzene Sulfonate | 5.000 | 5.000 |
| Coconut Fatty Acid | 4.000 | 4.000 |
| Sodium Laureth Sulfate (~60 wt % actives) | 26.000 | 26.000 |
| Bitrex | 0.050 | 0.050 |
| Enzymes (~10 wt % actives) | 2.950 | 2.950 |
| Tinopal CBS-X | 0.300 | 0.300 |
| Anti-Redeposition Polymer | 1.600 | 1.600 |
| Chelator (~33 wt % actives) | 0.900 | 0.900 |
| Fragrance | 1.600 | 1.600 |
| Dye | 0.026 | 0.026 |
| Total | | |

In Table 5 above, the components are as follows:

The liquid block copolymer has a weight average molecular weight of about 1000 g/mol, has the general formula (IV) set forth above wherein a ratio of PO:EO:PO is 1:2:1 (i.e., wherein the ratio of a:b:c is 1:2:1).

C12-C15 Alcohol Ethoxylate-7 E/O is a $C_{12}$-$C_{15}$ Alcohol Ethoxylate that is capped with approximately 7 moles of ethylene oxide.

Linear Alkylbenzene Sulfonate is 2-Phenyl Sulfonic Acid.

Bitrex is a bittering additive, which is a 25% active solution in water.

Enzymes are a combination of a commercially available protease, mannanase, and amylase.

Tinopal CBS-X is a commercially available optical brightener.

These Compositions 6 and 7 are evaluated to determine viscosity using an AR2000-EX Rheometer using an increasing shear rate of from about 0.41 to about 10 l/s over 5 minutes at 20° C. with a geometry cone of 40 mm, 1:59:49 degree:min:sec, and a truncation gap of 52 microns.

In a first series of viscosity evaluations, the Compositions 6 and 7 are evaluated neat, as set forth in Table 6 below.

In a second series of viscosity evaluations, the Compositions 6 and 7 are evaluated after dilution with water at a weight ratio of about 1:1 Composition:Water, as set forth in Table 7 below and in FIG. 3.

In a third series of viscosity evaluations, the Compositions 6 and 7 are evaluated after dilution with water at a weight ratio of about 2:1 Composition:Water, as set forth in Table 8 below and in FIG. 4.

TABLE 6

| Shear Rate (1/s) | Comp. 6 Comparative | Comp. 7 Inventive |
|---|---|---|
| | No Dilution in Water (Neat) Viscosity in Pa · S | |
| 0.41 | 0.483 | 0.2188 |
| 0.75 | 0.4787 | 0.1961 |
| 1.08 | 0.4728 | 0.1865 |
| 1.41 | 0.4702 | 0.182 |
| 1.73 | 0.4696 | 0.1784 |
| 2.06 | 0.4699 | 0.1761 |
| 2.39 | 0.472 | 0.1741 |

TABLE 6-continued

| Shear Rate (1/s) | Comp. 6 Comparative | Comp. 7 Inventive |
|---|---|---|
| | No Dilution in Water (Neat) Viscosity in Pa · S | |
| 2.72 | 0.4736 | 0.1733 |
| 3.06 | 0.4739 | 0.1745 |
| 3.39 | 0.4722 | 0.1766 |
| 3.71 | 0.4682 | 0.1759 |
| 4.05 | 0.4682 | 0.1747 |
| 4.37 | 0.4699 | 0.1736 |
| 4.71 | 0.4704 | 0.1748 |
| 5.03 | 0.4674 | 0.176 |
| 5.37 | 0.4673 | 0.1743 |
| 5.70 | 0.4698 | 0.1742 |
| 6.03 | 0.4673 | 0.1759 |
| 6.36 | 0.4664 | 0.1745 |
| 6.68 | 0.4693 | 0.1746 |
| 7.02 | 0.4667 | 0.1758 |
| 7.35 | 0.4676 | 0.1744 |
| 7.68 | 0.4687 | 0.1755 |
| 8.01 | 0.4682 | 0.1748 |
| 8.34 | 0.4713 | 0.1748 |
| 8.67 | 0.4708 | 0.1748 |
| 8.99 | 0.4733 | 0.1748 |
| 9.32 | 0.4724 | 0.1752 |
| 9.66 | 0.474 | 0.175 |
| 9.99 | 0.4718 | 0.1746 |

TABLE 7

| Shear Rate (1/s) | Comp. 6 Comparative | Comp. 7 Inventive |
|---|---|---|
| | Dilution at 1 Part Composition:1 Part Water Viscosity in Pa · S | |
| 0.41 | 48.97 | 0.04661 |
| 0.75 | 23.41 | 0.04905 |
| 1.08 | 14.59 | 0.04653 |
| 1.41 | 10.35 | 0.04532 |
| 1.73 | 7.827 | 0.04466 |
| 2.06 | 6.639 | 0.04411 |
| 2.39 | 5.181 | 0.04478 |
| 2.72 | 4.587 | 0.04511 |
| 3.06 | 4.183 | 0.04576 |
| 3.39 | 3.845 | 0.04558 |
| 3.71 | 3.472 | 0.04431 |
| 4.05 | 3.343 | 0.04381 |
| 4.37 | 3.109 | 0.04465 |
| 4.71 | 2.96 | 0.0452 |
| 5.03 | 2.799 | 0.04427 |
| 5.37 | 2.706 | 0.04393 |
| 5.70 | 2.678 | 0.04457 |
| 6.03 | 2.664 | 0.04462 |
| 6.36 | 2.591 | 0.04377 |
| 6.68 | 2.532 | 0.0449 |
| 7.02 | 2.482 | 0.04431 |
| 7.35 | 2.443 | 0.04433 |
| 7.68 | 2.386 | 0.04499 |
| 8.01 | 2.332 | 0.04401 |
| 8.34 | 2.298 | 0.04496 |
| 8.67 | 2.266 | 0.04416 |
| 8.99 | 2.239 | 0.04492 |
| 9.32 | 2.218 | 0.04416 |
| 9.66 | 2.219 | 0.04488 |
| 9.99 | 2.172 | 0.0443 |

TABLE 8

| Shear Rate (1/s) | Comp. 6 Comparative | Comp. 7 Inventive |
|---|---|---|
| | Dilution at 2 Part Composition:1 Part Water Viscosity in Pa · S | |
| 0.41 | 551.8 | 0.1736 |

TABLE 8-continued

| Shear Rate (1/s) | Comp. 6 Comparative Dilution at 2 Part Water Viscosity in Pa · S | Comp. 7 Inventive Composition:1 Part |
|---|---|---|
| 0.75 | 298 | 0.1693 |
| 1.08 | 195.6 | 0.1678 |
| 1.41 | 140.3 | 0.1668 |
| 1.73 | 108.4 | 0.1666 |
| 2.06 | 86.91 | 0.1661 |
| 2.39 | 71.98 | 0.1654 |
| 2.72 | 60.64 | 0.1653 |
| 3.06 | 51.64 | 0.1645 |
| 3.39 | 44.58 | 0.1637 |
| 3.71 | 39.6 | 0.1644 |
| 4.05 | 35.19 | 0.1645 |
| 4.37 | 31.44 | 0.1647 |
| 4.71 | 29.29 | 0.1637 |
| 5.03 | 26.6 | 0.1637 |
| 5.37 | 24.67 | 0.1639 |
| 5.70 | 23.83 | 0.1637 |
| 6.03 | 22.6 | 0.1637 |
| 6.36 | 21.59 | 0.1638 |
| 6.68 | 20.15 | 0.1632 |
| 7.02 | 18.16 | 0.1634 |
| 7.35 | 16.87 | 0.1636 |
| 7.68 | 17.22 | 0.1632 |
| 8.01 | 17.26 | 0.1636 |
| 8.34 | 16.78 | 0.1633 |
| 8.67 | 16.36 | 0.1632 |
| 8.99 | 15.37 | 0.163 |
| 9.32 | 13.85 | 0.1633 |
| 9.66 | 14.09 | 0.1631 |
| 9.99 | 12.95 | 0.1634 |

The results of these evaluations are summarized in Table 9 below wherein viscosity is set forth as Pa·S measured using an AR2000-EX Rheometer at a shear rate of 1.05 l/s at 20° C. with a geometry cone of 40 mm, 1:59:49 degree: min:sec, and a truncation gap of 52 microns.

TABLE 9

| Composition | Dilution | Viscosity Pa · S |
|---|---|---|
| Composition 6 Comparative | Neat | 0.4728 |
| | 2:1 Composition:Water | 195.6 |
| | 1:1 Composition:Water | 14.59 |
| Composition 7 Inventive | Neat | 0.1865 |
| | 2:1 Composition:Water | 0.1678 |
| | 1:1 Composition:Water | 0.04653 |

These results further demonstrate that use of the liquid block copolymer produces superior and unexpected results. More specifically, the use of the liquid block copolymer surprisingly reduces the viscosity of the detergent composition upon dilution with water.

Figure 3:
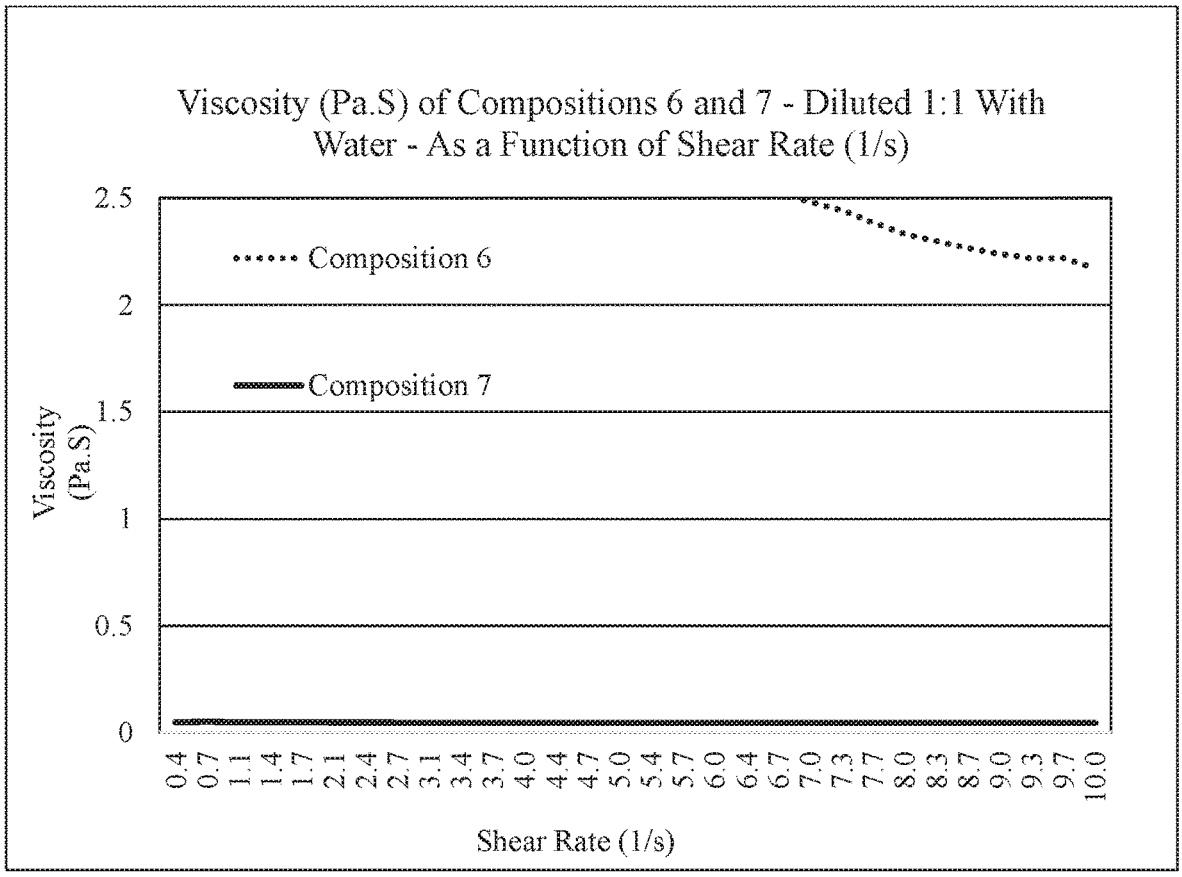
FIG. 3 is a line graph of Viscosity of Compositions 6 and 7—Diluted 1:1 With Water—as a Function of Shear Rate, as also set forth in the Examples.

FIG. 3 shows that the viscosity of Composition 7 is essentially independent of shear. This means that this detergent composition is a Newtonian fluid. In particular, Composition 7 shows a low viscosity.

Figure 4:
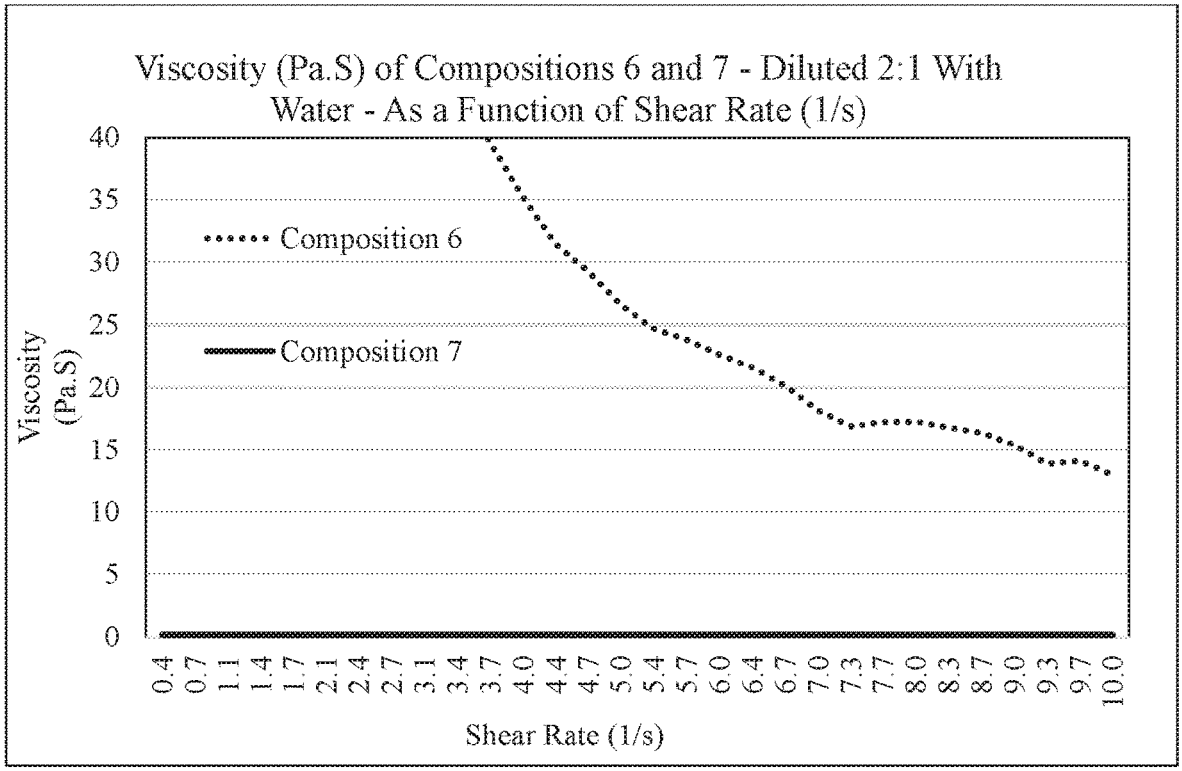
FIG. 4 is a line graph of Viscosity of Compositions 6 and 7—Diluted 2:1 With Water—as a Function of Shear Rate, as also set forth in the Examples.

FIG. 4 shows that the viscosity of Composition 7 is independent of shear and is low. This means this detergent composition is a Newtonian fluid. The viscosity of Composition 6 is initially non-Newtonian at a low shear rate but changes to Newtonian at a high shear rate.

As shown in the viscosity curve of Composition 7, using the rheology control agent changes the behavior of the fluid (from non-Newtonian to Newtonian) and lowers the viscosity of the Composition, upon dilution with water. Both are advantageous for dissolution of the unit dose detergent production upon exposed to water during use.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A unit dose detergent pack comprising:

a pouch made of a water-soluble film; and a detergent composition encapsulated within said pouch, wherein said detergent composition comprises:

A. a surfactant component comprising an alcohol ethoxy sulfate having a C8-C20 backbone that is ethoxylated with from about 1 to about 10 moles of ethylene oxide and is present in an amount of from about 5 to about 30 weight percent actives based on a total weight of said detergent composition;

B. water present in a total amount of from about 5 to about 30 weight percent based on a total weight of said detergent composition; and C. a liquid block copolymer present in an amount of at least about 0.5 weight percent actives based on a total weight of said detergent composition and having the following formulae:

R1O-(EO)*x*-(PO)*y*-R2 (I);

R1O-(PO)*x*-(EO)*y*-R2 (II);

R1O-(EO)*a*-(PO)*b*-(EO)*c*-R2 (III); and/or

R1O-(PO)*a*-(EO)*b*-(PO)*c*-R2 (IV)

wherein EO is a —CH2CH2O— group and PO is a —CH(CH3)CH2O— group;

wherein each of R1 and R2 is independently H or a C1-C22 alkyl group;

wherein each of x, y, a, b, and c is independently about 1 to about 70 provided that the weight average molecular weight of said liquid block copolymer is less than about 5,000 g/mol, wherein said detergent composition has a viscosity of less than about 5,000 cps when diluted with additional water at about a 2:1 weight ratio of detergent composition:water;

wherein said liquid block copolymer has formula (IV), a ratio of a:b:c is about 2.5:5:2.5, a+b+c is about 20 to about 30, each of R1 and R2 is H, and the weight average molecular weight is about 1,000 g/mol.

2. The unit dose pack of claim 1, wherein the viscosity is less than about 2,500 cps and is measured using a DV2T Brookfield viscometer at 20 rpm and 70° F. using spindle LV02(62).

3. The unit dose pack of claim 1, wherein the viscosity is less than about 2,500 cps and is measured using an AR2000-EX Rheometer at a shear rate of 1.08 l/s over 5 minutes at 20° C. with a geometry cone of 40 mm, 1:59:49 degree: min:sec, and a truncation gap of 52 microns.

4. The unit dose pack of claim 1, wherein the liquid block copolymer is present in an amount of from about 1 to about 7.5 parts actives by weight per 100 parts by weight of said detergent composition.

5. The unit dose pack of claim 1, wherein the liquid block copolymer is present in an amount of from about 2.5 to about 7.5 parts actives by weight per 100 parts by weight of said detergent composition.

6. The unit dose pack of claim 1, wherein the liquid block copolymer is present in an amount of from about 5 to about 7.5 parts actives by weight per 100 parts by weight of said detergent composition.

7. The unit dose pack of claim 1, wherein said alcohol ethoxy sulfate is sodium laureth sulfate.

8. The unit dose pack of claim 7, wherein said alcohol ethoxy sulfate is sodium laureth sulfate ethoxylated with about 2 to about 4 moles of ethylene oxide.

9. The unit dose pack of claim 1, wherein said alcohol ethoxy sulfate is sodium laureth sulfate ethoxylated with about 2 to about 4 moles of ethylene oxide and wherein said liquid block copolymer is present in an amount of from about 1 to about 7.5 weight percent actives based on a total weight of said detergent composition.

10. The unit dose pack of claim 1, wherein said surfactant component is present in an amount of from about 10 to about 20 weight percent actives based on a total weight of said detergent composition and said water is present in a total amount of from about 10 to about 18 weight percent based on a total weight of said detergent composition.

11. The unit dose pack of claim 1, wherein said surfactant component further comprises an additional anionic surfactant and a non-ionic surfactant.

12. The unit dose pack of claim 11, wherein said alcohol ethoxy sulfate, said additional anionic surfactant, and said non-ionic surfactant are present in a weight ratio of about 0.2:1:0.2 to about 5:1:5.

13. The unit dose pack of claim 11, wherein said additional anionic surfactant is linear alkylbenzene sulfonate and said non-ionic surfactant is an ethoxylated alcohol.

14. The unit dose pack of claim 1, wherein said surfactant component further comprises a non-ionic surfactant which is an ethoxylated alcohol comprising a C8-C20 backbone that is ethoxylated with from about 2 to about 12 moles of ethylene oxide.

15. A unit dose detergent pack comprising:

a pouch made of a water-soluble film; and a detergent composition encapsulated within said pouch, wherein said detergent composition comprises:

A. a surfactant component comprising an alcohol ethoxy sulfate having a C8-C20 backbone that is ethoxylated with from about 1 to about 10 moles of ethylene oxide and is present in an amount of from about 5 to about 30 weight percent actives based on a total weight of said detergent composition;

B. water present in a total amount of from about 5 to about 30 weight percent based on a total weight of said detergent composition; and C. a liquid block copolymer present in an amount of at least about 0.5 weight percent actives based on a total weight of said detergent composition and having the following formulae:

$$R1O\text{-}(EO)_x\text{-}(PO)_y\text{-}R2 \quad \text{(I);}$$

$$R1O\text{-}(PO)_x\text{-}(EO)_y\text{-}R2 \quad \text{(II);}$$

$$R1O\text{-}(EO)_a\text{-}(PO)_b\text{-}(EO)_c\text{-}R2 \quad \text{(III); and/or}$$

$$R1O\text{-}(PO)_a\text{-}(EO)_b\text{-}(PO)_c\text{-}R2 \quad \text{(IV)}$$

wherein EO is a —CH2CH2O— group and PO is a —CH(CH3)CH2O— group;

wherein each of R1 and R2 is independently H or a C1-C22 alkyl group;

wherein each of x, y, a, b, and c is independently about 1 to about 70 provided that the weight average molecular weight of said liquid block copolymer is less than about 5,000 g/mol, wherein said detergent composition has a viscosity of less than about 5,000 cps when diluted with additional water at about a 2:1 weight ratio of detergent composition:water;

wherein said liquid block copolymer has formula (IV) and the weight average molecular weight is about 200 to about 700 g/mol.

16. The unit dose pack of claim 15, wherein the liquid block copolymer is present in an amount of from about 1 to about 7.5 parts actives by weight per 100 parts by weight of said detergent composition.

17. The unit dose pack of claim 15, wherein said alcohol ethoxy sulfate is sodium laureth sulfate or sodium laureth sulfate ethoxylated with about 2 to about 4 moles of ethylene oxide.

18. The unit dose pack of claim 15, wherein said surfactant component is present in an amount of from about 10 to about 20 weight percent actives based on a total weight of said detergent composition and said water is present in a total amount of from about 10 to about 18 weight percent based on a total weight of said detergent composition.

19. The unit dose pack of claim 15, wherein said surfactant component further comprises an additional anionic surfactant and a non-ionic surfactant.

* * * * *